United States Patent [19]

Plewes

[11] 4,090,890

[45] May 23, 1978

[54] METHOD FOR MAKING COPPER-NICKEL-TIN STRIP MATERIAL

[75] Inventor: John Travis Plewes, Berkeley Heights, N.J.

[73] Assignee: Bell Telephone Laboratories, Incorporated, Murray Hill, N.J.

[21] Appl. No.: 685,262

[22] Filed: May 11, 1976

[51] Int. Cl.[2] ..... C22F 1/08

[52] U.S. Cl. ..... 148/12.7 C

[58] Field of Search ..... 148/12.7 C

[56] References Cited

U.S. PATENT DOCUMENTS

| | | | |
|---|---|---|---|
| 1,816,509 | 7/1931 | Wise | 148/12.7 R |
| 2,128,122 | 8/1938 | Dahl et al. | 148/12.7 C |
| 2,275,188 | 3/1942 | Harrington | 148/12.7 C |
| 3,937,638 | 2/1976 | Plewes | 148/12.7 |
| 3,940,290 | 2/1976 | Pryor et al. | 148/12.7 C |
| 3,941,620 | 3/1976 | Pryor et al. | 148/12.7 C |

OTHER PUBLICATIONS

Gohn et al.; "The Mechanical Properties of Wrought Phosphor Bronze Alloys"; American Society for Testing Materials 1956.

Gohn et al.; "The Mechanical Properties of Copper--Beryllium Strip;" American Society for Testing Materials, 1964.

Fetz, E.; Zeitschrift fur Metallkunde 28; 1936; pp. 350–353.

Patton, A.M.; The British Foundryman; 1962, pp. 129–135.

*Primary Examiner*—W. Stallard

*Attorney, Agent, or Firm*—Peter V. D. Wilde

[57] ABSTRACT

A method is disclosed for making strip material of a copper-nickel-tin alloy by cold rolling a homogenized ingot by an amount corresponding to an area reduction of from 25% to 45% followed by aging at a temperature in the vicinity of 350° C. Strip material made by the disclosed method exhibits not only high strength but also high and essentially isotropic formability.

5 Claims, 2 Drawing Figures

METHOD FOR MAKING COPPER-NICKEL-TIN STRIP MATERIAL

BACKGROUND OF THE INVENTION

1. Field of the Invention

The invention is concerned with the manufacture of metal strip material.

2. Description of the Prior Art

Articles such as springs, diaphragms, bellows, clips, electrical contacts, and small structural parts are typically manufactured by stamping from rolled strip material made from a cast ingot. Among desirable mechanical properties of such material are high yield strength and high ductility; other desirable properties are corrosion resistance, high electrical conductivity, and ease of soldering.

Among alloys suitable for applications such as those mentioned above are phosphor-bronze and beryllium-copper alloys as discussed, respectively, in G. R. Gohn et al, "The Mechanical Properties of Wrought Phosphor Bronze Alloys", American Society for Testing Materials, 1956 and G. R. Gohn et al, "The Mechanical Properties of Copper-Beryllium Alloy Strip", American Society for Testing and Materials, 1964. Up until recently, copper-nickel-tin alloys were not considered to be viable substitutes for phosphor bronze or copper-beryllium alloys due largely to inadequate formability of available copper-nickel-tin alloys. Investigations into the properties of such copper-nickel-tin alloys are described, e.g., in E. M. Wise et al, "Strength and Aging Characteristics of the Nickel Bronzes", Metal Technology, No. 523, January 1964, pages 218–244; E. Fetz, "Uber Aushartbare Bronzen Auf Kupfer-Nickel-Zinn-Basis", Zeitschrift fur Metallkunde 28, 1936, pages 350–353; and A. M. Patton, "The Effect of Section Thickness on the Mechanical Properties of a Cast Age-Hardenable Copper-Nickel-Tin Alloy", The British Foundryman, April 1962, pages 129–135, and exemplary metallurgical processing of such alloys is disclosed in U.S. Pat. No. 1,816,509, "Method of Treatment of Nonferrous Alloys", E. M. Wise, July 28, 1931.

In contrast to the relatively brittle copper-nickel-tin alloys dealt with in the above-mentioned references, U.S. Pat. No. 3,937,638, "Method for Treating Copper-Nickel-Tin Alloy Compositions and Products Produced Therefrom", issued to J. T. Plewes on Feb. 10, 1976, and assigned to the assignee hereof, discloses alloys which are strong as well as ductile. Such combination of properties is achieved by thermomechanical processing involving cold working by an amount of at least 75% area reduction followed by aging at a temperature depending on alloy composition and amount of cold work. The composition of these alloys is characterized in that such alloys are in a single phase state at a temperature near the melting point of the alloy but in a two-phase state at room temperature. It is believed that the unusual combination of high strength and high ductility achieved is due to inhibition of second phase precipitation at the grain boundaries in favor of a so-called spinodal transformation, which characteristically leads to fine dispersement of the second phase throughout the first phase. More recently, it has been discovered that certain quaternary alloys also undergo such a spinodal transformation. These alloys are disclosed in copending application J. T. Plewes 4, Ser. No. 685,263, filed May 11, 1976, now U.S. Pat. No. 4,052,204, and are obtained by substituting substantial amounts of a fourth element for a corresponding amount of copper in the ternary alloys disclosed in U. S. Pat. No. 3,937,638.

Due to their high strength, high ductility, and low cost spinodal copper-nickel-tin alloys are of interest as potential substitutes for phosphor-bronze and copper-beryllium alloys in the manufacture of strip material. While the alloys disclosed in U.S. Pat. No. 3,937,638 and copending application, J. T. Plewes 4, Ser. No. 685,263, are suitable for the manufacture of strip material, use of the resulting strip is most advantageous in applications which do not require sharp bending of the rolled strip such as would cause creasing of the strip in a direction having a substantial component parallel to the rolling direction. Due to anisotropy, i.e., directionally nonuniform formability, attempts at imparting such creases to a rolled strip may result in breakage of the strip.

SUMMARY OF THE INVENTION

It has been discovered that copper-nickel-tin alloys having a composition falling within the shaded area of the three-component diagram shown in FIG. 1, are rendered strong, and of high and essentially isotropic formability when subjected to thermo-mechanical working including homogenizing, cold rolling by an amount corresponding to an area reduction of from 25% to 45% and aging at a temperature in the vicinity of 350° C. The resulting strip material is suitable for the manufacture of stamped articles whose shaping involves sharp bending resulting in creases in any direction.

DETAILED DESCRIPTION

Figure 1:
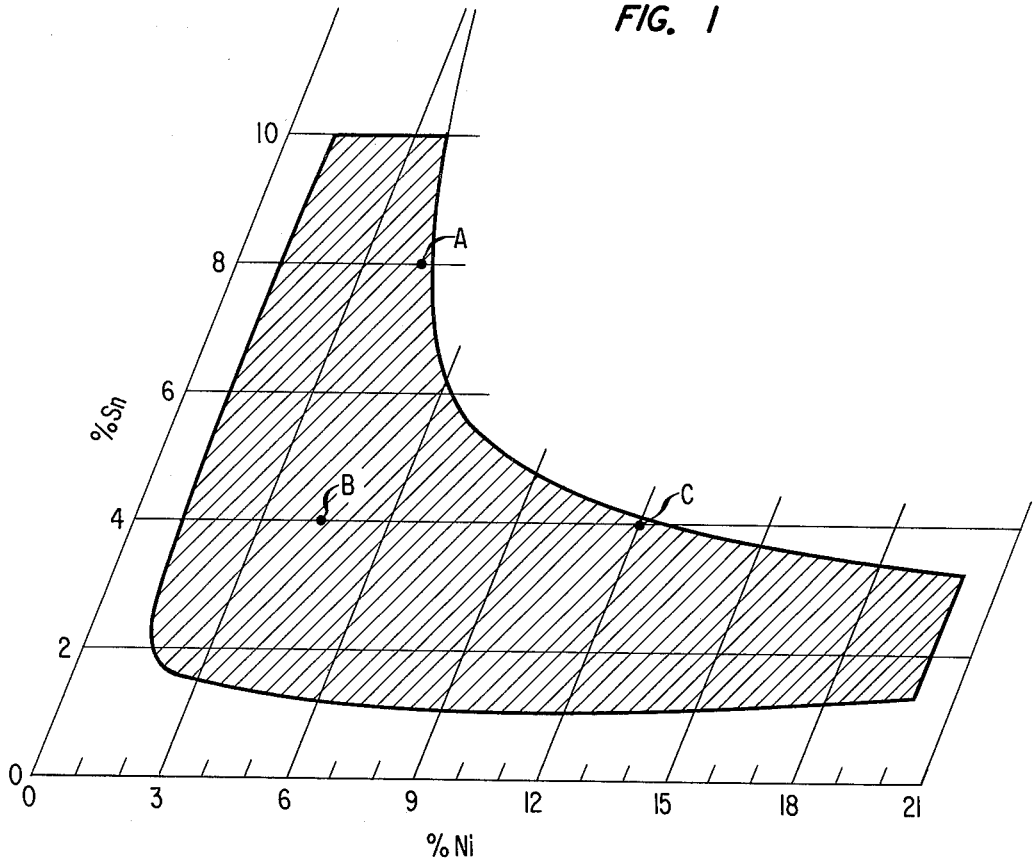
FIG. 1 is a portion of the three-component diagram of copper-nickel-tin alloys.

FIG. 1 shows a shaded area of the copper-nickel tin compositional diagram corresponding to compositions of interest in connection with the claimed invention. Points A, B, and C are emphasized corresponding to three exemplary alloys, namely alloys containing, respectively, 4% Ni, and 8% Sn (point A), 4% Ni and 4% Sn (point B), and 12% Ni and 4% Sn (point C), remainder Cu.

Figure 2:
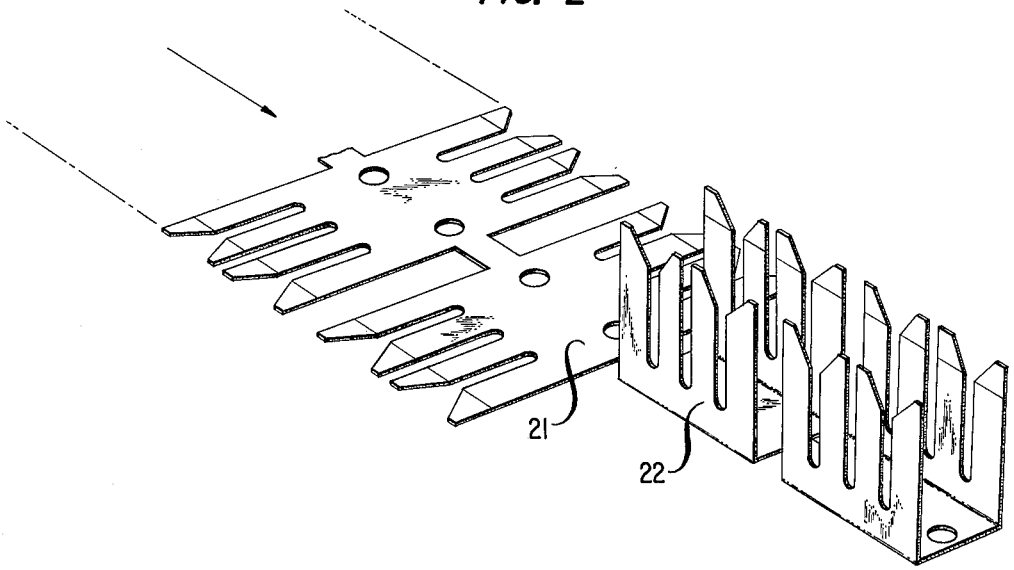
FIG. 2 shows a Cu-Ni-Sn strip manufactured according to the disclosed method and which has partially undergone stamping and bending.

FIG. 2 shows a strip one half inch wide and 25 mils thick and made from an alloy of a composition corresponding to point B of FIG. 1. The strip was worked according to the method disclosed below; a portion of the strip is shown processed further as in the manufacture of electrical wire clips. Specifically, portion 21 of the strip is shown perforated and notched by stamping and portion 22 is shown bent sharply so as to result in a lt bend in a direction transverse to the rolling direction which is indicated by an arrow.

As a preliminary step to the treatment described below a Cu-Ni-Sn ingot having a composition corresponding to a point in the shaded area of FIG. 1, is subjected to a homogenizing treatment such as by annealing followed by rapid quenching sufficient to achieve a uniformly fine grain structure of a supersaturated solid solution of single phase material. Average grain size of the homogenized ingot should preferably not exceed 100 micrometers and should preferably be on the order of about ten micrometers. The ingot may be as cast or may have undergone preliminary shaping such as by hot working, cold working, or warm working as disclosed in pending application Hinrichsen-Plewes 1-3, Ser. No. 620,644 now U.S. Pat. No. 4,012,240.

Following homogenization, the ingot is subjected to cold working by amounts in the range of from 25% to 45%; amounts above 45% tend not to maintain essentially isotropic formability, amounts below 25% do not lead to full realization of the potential strength of these alloys. After rolling, the strip is aged at a temperature in the range of from 250° C to 450° C to achieve the desired combination of strength and ductility. Aging time is preferably selected for aging to take place uniformly throughout the rolled strip and consequently is preferably chosen in direct relationship to the thickness of the strip. For very thin strips, aging for a duration of as little as 20 seconds may be effective such as in continuous strand aging; for thick strips, aging times as long as 30 hours may be preferred to ensure essentially homogeneous aging. Since aging time and aging temperature are related according to a so-called Arrhenius relationship, lower aging times can be compensated for by higher aging temperatures and conversely; specifically, it was found that an increase of 50° C in aging temperature allows a tenfold decrease in aging time. For example, the desired combination of high ductility and high yield strength is achieved in an alloy containing 4% Ni and 4% Sn and remainder Cu and cold worked corresponding to 37% area reduction, either by aging for eight hours at a temperature of 350° C or by aging for 50 minutes at a temperature of 400° C. Preferred aging times corresponding to an aging temperature of 350° C are shown in Table 1 for the three alloys labelled A, B, and C in FIG. 1. After homogenization, these alloys were cold rolled by an amount corresponding to 37% area reduction and aged at a temperature of 350° C. Table 1 also shows yield strengths in pounds per square inch of the processed strips as well as smallest bend radius relative to strip thickness, a quantity indicative of formability. For other alloys in the claimed compositional range, preferred aging times corresponding to an aging temperature of 350° C can be determined by interpolating or extrapolating based on the aging times given for the exemplary alloys. In general, for fixed contents of Sn, aging times increase as Ni contents increase and, for fixed contents of Ni, aging times decrease as Sn contents increase.

While the treatment was described above as applied to three-component alloys of copper, nickel, and tin, certain amounts of fourth elements, either alone or in combination, may be tolerated without significant detrimental effects. In the interest of isotropy of formability, the limits on Fe, Zn, and Mn are somewhat more narrow than those disclosed in copending application J. T. Plewes 4, Ser. No. 685,263.

Specifically, up to 10% Fe, up to 7% Zn or up to 10% Mn may replace a corresponding amount of Cu without significant adverse effects on alloy properties. When used in combination the total amount of Fe, Zn and Mn should preferably not exceed 10%. For reasons such as facilitating hot working prior to homogenization, enhancing ductility, or enhancing strength of the worked alloy, small amounts of the following elements may also be present: Zr in amounts of up to 0.15%, Nb in amounts of up to 0.3%, Cr in amounts of up to 1.0%, Al in amounts of up to 1.5%, or Mg in amounts of up to 1.0%. If present in combination, the combined amount of these additives should preferably not exceed 1.5% in the interest of preventing inhibition of the spinodal transformation.

TABLE

| Example | Composition Cu-Ni-Sn | Aging Time | 0.01% Yield Strength | Smallest Bend |
|---|---|---|---|---|
| A | 88-4-8 | 0.2 h | 100,000 | 2t |
| B | 92-4-4 | 8 h | 77,000 | 0.5t |
| C | 84-12-4 | 20 h | 105,000 | 2t |

What is claimed is:

1. A method of producing high strength Cu-Ni-Sn strip material from an alloy comprising a composition falling within the shaded area of FIG. 1 and containing not less than 4% Sn CHARACTERIZED IN THAT said ingot is processed by a sequence of steps which terminates in the sequential steps of (1) homogenizing, (2) cold rolling by an amount corresponding to an area reduction of from 25% to 45%, and (3) aging at a temperature in the range of from 250° C to 450° C whereby essentially isotropic formability is obtained.

2. Method of claim 1 in which said alloy is aged for a time of from 20 seconds to 30 hours.

3. Method of claim 1 in which said homogenized ingot has an average grain size not in excess of 100 microns.

4. Method of claim 3 in which said homogenized ingot has an average grain size in the vicinity of 10 microns.

5. Method of claim 1 in which said alloy contains, as a substitute for a corresponding amount of Cu, at least one element selected from the group consisting of:

Fe in an amount of up to 10%,
Zn in an amount of up to 7%,
Mn in an amount of up to 10%,
Zr in an amount of up to 0.15%,
Nb in an amount of up to 0.3%,
Cr in an amount of up to 1%,
Al in an amount of up to 1.5%, or
Mg in an amount of up to 1%.

* * * * *